US005780416A

United States Patent [19]

Kiewert et al.

[11] Patent Number: 5,780,416

[45] Date of Patent: Jul. 14, 1998

[54] ACIDIC HARD SURFACE CLEANING FORMULATIONS COMPRISING APG AND PROPOXYLATED-ETHOXYLATED FATTY ALCOHOL ETHER

[75] Inventors: Eva Kiewert, Duesseldorf; Ronald Menke, Mettmann; Birgit Middelhauve, Monheim, all of Germany

[73] Assignee: Henkel Kommanditgesellschaft auf Aktien, Duesseldorf, Germany

[21] Appl. No.: 687,553

[22] PCT Filed: Feb. 1, 1995

[86] PCT No.: PCT/EP95/00357

§ 371 Date: Oct. 10, 1996

§ 102(e) Date: Oct. 10, 1996

[87] PCT Pub. No.: WO95/21905

PCT Pub. Date: Aug. 17, 1995

[30] Foreign Application Priority Data

Feb. 10, 1994 [DE] Germany ..... 44 04 199.3

[51] Int. Cl.[6] ..... C11D 1/722; C11D 1/825; C11D 3/22

[52] U.S. Cl. ..... 510/422; 510/421; 510/434; 510/470; 510/477; 510/506

[58] Field of Search ..... 510/470, 421, 510/422, 506, 434, 477; 252/239, 241, 242

[56] References Cited

U.S. PATENT DOCUMENTS

| | | | |
|---|---|---|---|
| 4,705,665 | 11/1987 | Malik | 422/12 |
| 4,965,014 | 10/1990 | Jaeschke et al. | 252/174.22 |
| 5,356,479 | 10/1994 | Menke et al. | 143/2 |
| 5,374,716 | 12/1994 | Biermann et al. | 536/18.6 |
| 5,576,284 | 11/1996 | Van Buskirk et al. | 510/384 |
| 5,591,376 | 1/1997 | Kiewert et al. | 510/437 |
| 5,602,093 | 2/1997 | Haerer et al. | 510/514 |

FOREIGN PATENT DOCUMENTS

| | | |
|---|---|---|
| 1338237 | 9/1989 | Canada . |
| 202 638 | 11/1986 | European Pat. Off. . |
| 301 298 | 2/1989 | European Pat. Off. . |
| 36 43 895 | 6/1988 | Germany . |
| 2 194 536 | 3/1988 | United Kingdom . |
| 2 242 686 | 10/1991 | United Kingdom . |
| WO 86/2943 | 5/1986 | WIPO . |
| 88/09369 | 12/1988 | WIPO . |
| WO 90/3977 | 4/1990 | WIPO . |
| WO 91/14760 | 10/1991 | WIPO . |
| WO 93/20179 | 10/1993 | WIPO . |
| WO 94/07982 | 4/1994 | WIPO . |
| WO 94/22997 | 10/1994 | WIPO . |

*Primary Examiner*—Ardith Hertzog
*Attorney, Agent, or Firm*—Ernest G. Szoke; Wayne C. Jaeschke; Real J. Grandmaison

[57] ABSTRACT

A water-containing cleaning composition having a pH value of 3.0 to 6.5 containing 0.1% to 50% by weight of at least one alkyl glycoside corresponding to formula (I):

$$R^1—O—[G]_x$$

wherein $R^1$ is a branched or linear, saturated or unsaturated alkyl group containing 6 to 11 carbon atoms, G is a glycose or xylose unit and x is a number of 1 to 10, 0. 1 % to 30% by weight of at least one fatty alcohol ether corresponding to formula (II)

$$R^2—O—(CH_2\overset{\overset{CH_3}{|}}{C}HO)_m(CH_2CH_2O)_nH \qquad \text{(II)}$$

in which $R^2$ is an alkyl radical containing 6 to 12 carbon atoms, m is a number of 0.5 to 3.0 and n is a number of 4.0 to 12.0, based on the weight of the composition, and which is free from hydrotropes based on organic acids.

12 Claims, No Drawings

ACIDIC HARD SURFACE CLEANING FORMULATIONS COMPRISING APG AND PROPOXYLATED-ETHOXYLATED FATTY ALCOHOL ETHER

BACKGROUND OF THE INVENTION

1. Field of the Invention

This invention relates to cleaning formulations for hard surfaces. Hard surfaces in the context of the invention are any non-textile surfaces encountered in the domestic and institutional sectors with the exception of crockery.

The name "multipurpose cleaners" has been coined for cleaning formulations of this type. Multipurpose cleaners have been known for some considerable time. They are essentially aqueous surfactant solutions of various kinds with or without added builders and with or without added water-soluble solvents or solubilizers. Consumers expect multipurpose cleaners to be effective against all kinds of soils encountered in the home. Conventional mildly alkaline or neutral multipurpose cleaners largely satisfy these requirements in regard to oily, fatty and dust-like soils. In addition, however, consumers expect the lime-containing soils encountered above all in bathrooms and also in kitchens to be readily removable. To meet this requirement, the production of acidic multipurpose cleaners is an option. However, it has been found in practice that acidic multipurpose cleaners cannot be produced simply by acidifying conventional multipurpose cleaners because, in this case, problems are often encountered in regard to making up, low-temperature stability and/or stability in storage, particularly with regard to any perfume oils present. In addition, a considerable quantity of hydrotropes is often necessary to dissolve all the components. However, it would be desirable not to have to use hydrotropes because they generally do not make any contribution towards the performance of the cleaner.

2. Discussion of Related Art

Thus, International patent application WO 86/2943 discloses acidic cleaning formulations which contain anionic surfactants and - to adjust viscosity-monoglycosides.

The problem addressed by the present invention was to provide high-performance acidic cleaning formulations for hard surfaces, so-called multipurpose cleaners, which would be easy to formulate and stable at low temperatures and in storage and which would show the requirement profile mentioned above, even without the use of hydrotropes. According to the invention, this problem has been solved by combining a $C_{6-11}$ alkyl glycoside with a specific fatty alcohol ether.

DESCRIPTION OF THE INVENTION

The present invention relates to water-containing cleaning formulations with a pH value of 3.0 to 6.5 and preferably 3.5 to 5.5 containing 0.1 to 50% by weight and preferably 1.0 to 10% by weight of at least one alkyl glycoside corresponding to formula I, $R^1—O—|G|_x$, where $R^1$ is a branched or linear, saturated or unsaturated alkyl group containing 6 to 11 and preferably 8 to 10 carbon atoms, G is a glycose unit, preferably a glucose or xylose unit, and x is a number of 1 to 10 and preferably 1.1 to 3.0, 0.1 to 30% by weight and preferably 0.5 to 10% by weight of at least one fatty alcohol ether corresponding to formula II:

$$R^2—O—(\overset{\overset{\displaystyle CH_3}{|}}{CH_2CHO})_m(CH_2CH_2O)_nH \qquad (II)$$

in which $R^2$ is an alkyl radical containing 6 to 12 carbon atoms, m is a number of 0.5 to 3.0 and n is a number of 4.0 to 12.0.

More particularly, m in formula (II) is a number of 1.0 to 2.0 and n is a number of 6.0 to 11.0.

Alkyl glycosides are known substances which may be obtained by the relevant methods of preparative organic chemistry. EP-A1-0 301 298 and WO 90/3977 are cited as representative of the extensive literature available on the subject. The alkyl glycosides may be derived from aldoses or ketoses containing 5 or 6 carbon atoms, preferably from glucose and xylose. Accordingly, the preferred alkyl glycosides are alkyl glucosides and xylosides.

The index x in general formula (I) indicates the degree of oligomerization (DP degree), i.e. the distribution of monoglycosides and oligoglycosides, and is a number of 1 to 10. Whereas x in a given compound must always be an integer and, above all, may assume a value of 1 to 6, the value x for a certain alkyl glycoside is an analytically determined calculated quantity which is generally a broken number. Alkyl glycosides with an average degree of oligomerization x of 1.1 to 3.0 are preferably used. Alkyl glycosides with a degree of oligomerization below 2.0 and, more particularly, from 1.2 to 1.6 are preferred from the performance point of view.

The alkyl radical $R^1$ may be derived from primary alcohols containing 6 to 11 carbon atoms and preferably 8 to 10 carbon atoms. Typical examples are caproic alcohol, caprylic alcohol, capric alcohol and undecyl alcohol and the technical mixtures thereof obtained, for example, in the hydrogenation of technical fatty acid methyl esters or in the hydrogenation of aldehydes from Roelen's oxosynthesis. Alkyl glucosides and alkyl xylosides with a chain length of $C_8$ to $C_{10}$ (DP=1.1 to 3), of which the fatty alcohol component accumulates as first runnings in the separation of technical $C_{8-18}$ cocofatty alcohol by distillation and which may contain less than 15% by weight and preferably less than 6% by weight of $C_{12}$ alcohol as an impurity, are preferably used.

The fatty alcohol ethers corresponding to formula (II) are adducts of propylene oxide and ethylene oxide with primary alcohols containing 6 to 12 carbon atoms, i.e. for example with hexanol, octanol, decanol, dodecanol or with a head-fractionated $C_{8-10}$ fatty alcohol.

The numbers m and n in formula (II) are average degrees of propoxylation or ethoxylation and, as analytically determined quantities, may even be broken numbers. The average degree of propoxylation m is 0.5 to 3.0, preferably 1.0 to 2.0 and more preferably 1.1 to 1.5; the average degree of ethoxylation n is 4.0 to 12.0, preferably 7.0 to 11.0 and more preferably 8.0 to 10.0. The $C_{6-10}$ alcohol is first propoxylated and then ethoxylated, i.e. the ethylene glycol units are preferably situated at the end of the molecule.

The production of these substances and their use in detergents and cleaners are described in DE-OS 36 43 895.

The cleaning formulations according to the invention may optionally contain other nonionic surfactants in quantities of 0.1 to 10% by weight and preferably in quantities of 0.1 to 2.0% by weight, based on the cleaning formulation as a whole, for example fatty acid polyhydroxyamides, for example glucamides, and the conventional ethoxylates of fatty alcohols, alkylamines, vicinal diols and/or carboxylic acid amides containing $C_{10-22}$ and preferably $C_{12-18}$ alkyl groups. The degree of ethoxylation of these compounds is generally between 1 and 20 and preferably between 3 and 10. They may be prepared in known manner by reaction with ethylene oxide. The ethanolamide derivatives of alkanoic acids containing 8 to 22 and preferably 12 to 16 carbon atoms are preferred. Particularly suitable compounds include lauric acid, myristic acid and palmitic acid monoethanolamides.

In addition, the cleaning formulations according to the invention may contain typical anionic surfactants in quantities of 0.1 to 10% by weight and preferably in quantities of 0.1 to 2.0% by weight, based on the cleaning formulation as a whole, as an additional surfactant component. Suitable anionic surfactants are, for example, alkyl sulfates, alkyl ether sulfates, sulfofatty acid disalts, sulfofatty acid alkyl ester salts, alkane sulfonates, isethionates, taurides, sarcosinates, ether carboxylates and/or alkyl benzene sulfonates containing linear $C_{9-15}$ alkyl groups at the benzene nucleus. Useful surfactants of the sulfate type include, in particular, primary alkyl sulfates with preferably linear $C_{10-20}$ alkyl groups which contain an alkali metal, ammonium or alkyl- or hydroxyalkyl-substituted ammonium ion as counter cation. The derivatives of linear alcohols containing, in particular, 8 to 18 carbon atoms and branched-chain analogs thereof, so-called oxoalcohols, are particularly suitable. Accordingly, the sulfation products of primary fatty alcohols with linear octyl, decyl, dodecyl, tretradecyl, hexadecyl or octadecyl groups and mixtures thereof are particularly suitable. The alkyl sulfates may be prepared in known manner by reaction of the corresponding alcohol component with a typical sulfating agent, more especially sulfur trioxide or chlorosulfonic acid and subsequent neutralization with alkali metal, ammonium or alkaline or hydroxyalkyl-substituted ammonium bases.

In addition, the sulfated alkoxylation products of the alcohols mentioned, so-called ether sulfates, may be used as the anionic surfactant component. Ether sulfates such as these preferably contain 2 to 30 and more preferably 4 to 20 ethylene glycol groups per molecule.

Suitable anionic surfactants of the sulfonate type also include the sulfoesters obtainable by reaction of fatty acid esters with sulfur trioxide and subsequent neutralization, more especially the sulfonation products derived from $C_{8-22}$ and preferably $C_{12-18}$ fatty acids and linear $C_{-1-6}$ and preferably $C_{1-4}$ alcohols, and the sulfofatty acid disalts derived therefrom. Suitable alkane sulfonates are substances obtained by sulfoxidation of hydrocarbons preferably containing 10 to 20 carbon atoms. Products in which the sulfonic acid substituents are statistically distributed and, if desired, may be removed in known manner are generally formed. In all cases of the anionic surfactants mentioned, suitable cations are in particular those from the group of alkali metal ions and ammonium or alkyl- or hydroxyalkyl-substituted ammonium ions.

However, the cleaning formulations according to the invention solve the problem stated above even without the anionic surfactants optionally present so that they need not be used.

In principle, a mixture of any organic or inorganic acid with its salt, for example phosphoric acid, phosphorous acid, hydrochloric acid, sulfuric acid, formic acid, may be used to establish the pH value according to the invention of 3.0 to 6.5, preferably 3.5 to 5.5 and more preferably 4.0 to 4.5, although a mono-, di- or tricarboxylic acid containing 2 to 6 carbon atoms is preferably used. Lactic acid, tartaric acid, malic acid, glycolic acid, glyoxylic acid, succinic acid, adipic acid, glutaric acid and especially citric acid are preferred. The acid/salt mixture is present in quantities of 0.1 to 15% by weight and preferably in quantities of 1.0 to 5.0% by weight, based on the formulation as a whole, depending on which pH value lying in the range according to the invention is ultimately required. Suitable salts are, for example, ammonium and $C_{2-4}$ mono- and dialkanolammonium salts, although the alkali metal salts are preferred. In the most simple case, a mixture of acid and corresponding alkali metal salt is obtained by initially introducing the acid and partly neutralizing it with an alkali metal hydroxide, for example NaOH.

Combinations of various acids with their respective salts may of course also be used.

The pH value for an in-use concentration of 10 g of cleaner per liter of solution is normally in the range from 4.0 to 6.0. The cleaning formulations according to the invention are generally aqueous preparations, although water-miscible organic solvents, for example methanol, ethanol, propanol, isopropanol and mixtures thereof, may additionally be used.

Other additives typically present in cleaning formulations are viscosity regulators, for example synthetic polymers such as, for example, homopolymers and copolymers of acrylic acid, polyethylene glycol, biosynthetic polymers, for example xanthan gum; preservatives, for example glutaraldehyde; dyes, opacifiers and perfume oils.

The formulations according to the invention may be prepared simply by mixing the individual components which may be present either as such or optionally in the form of aqueous solutions.

So far as the perfume oils normally but not necessarily present in cleaning formulations are concerned, it has been found that the surfactant combination according to the invention of alkyl glycosides corresponding to formula I and fatty alcohol ethers corresponding to formula II produces a distinct improvement in the incorporation of perfume oils, i.e. the perfume oils are easier to incorporate and also lead to formulations with better stability in storage than is the case with conventional cleaning formulations.

The hydrotropes, for example short-chain ($C_{2-6}$) alcohols, for example butylene glycol; cumene sulfonate and butyl glycoside, used in conventional cleaning formulations may optionally be added to the cleaning formulations according to the invention. However, the cleaning formulations according to the invention solve the problems stated in the foregoing without hydrotropes.

The formulations according to the invention are particularly suitable for cleaning hard surfaces, for example enamel, glass, PVC, linoleum or ceramic tiles, particularly in bathrooms and kitchens, where lime-containing soils are encountered. However, acid-sensitive materials, such as marble for example, should be cleaned with the formulations according to the invention.

EXAMPLES

Compositions E1 and E2 according to the invention and comparison compositions C1 to C4 were prepared by mixing the components (quantities in % by weight):

| | E1 | E2 | C1 | C2 | C3 | C4 |
|---|---|---|---|---|---|---|
| $C_{8-10}$APG | 3.5 | 3.5 | — | — | 3.5 | 3.5 |
| $C_{12-16}$APG | — | — | 3.5 | 3.5 | — | — |
| $C_{8-10}$FA × 1.2 PO × 6 EO | 1.5 | 1.5 | 1.5 | 1.5 | — | — |
| $C_{12-14}$FA × 7 EO | — | — | — | — | 1.5 | 1.5 |

-continued

| | E1 | E2 | C1 | C2 | C3 | C4 |
|---|---|---|---|---|---|---|
| Citric acid (water-free) | 6.0 | 6.0 | 6.0 | 6.0 | 6.0 | 6.0 |
| NaOH for adjustment to pH: | 4.3 | 4.3 | 4.3 | 4.3 | 4.3 | 4.3 |
| Ethanol(hydrotrope) | — | 1.0 | — | 1.0 | — | 1.0 |
| Xanthan gum | 0.2 | 0.2 | 0.2 | 0.2 | 0.2 | 0.2 |
| Perfume oil | 0.9 | 0.9 | 0.9 | 0.9 | 0.9 | 0.9 |
| Rest water | | | | | | |
| Appearance of the product at room temperature | Clear | Clear | Cloudy | Cloudy | Clear | Clear |
| Appearance of the product after storage for 1 week at 40° C. | Clear | Clear | | | Cloudy | Cloudy |

$C_{8-10}$APG: $C_{8-10}$alkyl 1.6 glucoside (DP = 1.6)
$C_{12-16}$APG: $C_{12-16}$alkyl 1.4 glucoside (DP = 1.4)
FA: Fatty alcohol
PO: Propylene oxide
EO: Ethylene oxide
$C_{8-10}$FA × 1.2 PO × 6 EO: $C_{8-10}$ fatty alcohol which was first 1.2× propoxylated and then 6× ethoxylated.

Both with and without hydrotropes, the Examples according to the invention give clear products which remain clear even after storage at 40° C. and subsequent cooling to normal ambient temperature (20°–25° C.).

By contrast, Comparison Examples C1 and C2 are cloudy products immediately after their production. Comparison Examples C3 and C4 are clear immediately after their production, but turn cloudy after storage.

What is claimed is:

1. A water-containing cleaning composition having a pH value of 3.0 to 6.5 consisting essentially of 0.1% to 50% by weight of at least one alkyl glycoside corresponding to formula (I):

$$R^1—O—[G]_x \quad (I)$$

wherein $R^1$ is a branched or linear, saturated or unsaturated alkyl group containing 6 to 11 carbon atoms, G is a glycose or xylose unit and x is a number of 1 to 10, 0.1% to 30% by weight of at least one fatty alcohol ether corresponding to formula (II):

$$R^2—O—(CH_2\overset{\overset{CH_3}{|}}{C}HO)_m(CH_2CH_2O)_nH \quad (II)$$

in which $R^2$ is an alkyl radical containing 6 to 12 carbon atoms, m is a number of 0.5 to 3.0 and n is a number of 4.0 to 12.0, based on the weight of said composition, said pH value having been adjusted with a mixture of an organic or inorganic acid and a salt thereof.

2. A composition as in claim 1 wherein said pH value of 3.0 to 6.5 is adjusted with a mixture of 0.1% to 15% by weight, based on the composition as a whole, of an organic mono-, di- or tricarboxylic acid containing 2 to 6 carbon atoms or an alkali metal salt thereof.

3. A composition as in claim 2 wherein said organic mono-, di- or tricarboxylic acid containing 2 to 6 carbon atoms is selected from the group consisting of citric acid, lactic acid, tartaric acid, malic acid, glycolic acid, glyoxylic acid, succinic acid, adipic acid and glutaric acid.

4. A composition as in claim 3 wherein said organic mono-, di- or tricarboxylic acid containing 2 to 6 carbon atoms is citric acid.

5. A composition as in claim 1 having a pH value of 3.5 to 5.5.

6. A composition as in claim 5 wherein said pH value of 3.5 to 5.5 is adjusted with a mixture of 1.0% to 5% by weight, based on the composition as a whole, of an organic, mono-, di- or tricarboxylic acid containing 2 to 6 carbon atoms or an alkali metal salt thereof.

7. A composition as in claim 1 containing 1% to 10% by weight of at least one alkyl glycoside corresponding to formula (I).

8. A composition as in claim 1 wherein $R^1$ is a linear or branched, saturated or unsaturated alkyl group containing 8 to 10 carbon atoms.

9. A composition as in claim 1 wherein G is a glycose unit.

10. A composition as in claim 1 wherein x is a number of 1.1 to 3.0.

11. A composition as in claim 1 containing 0.5% to 10% by weight of a fatty alcohol ether corresponding to formula (II).

12. A composition as in claim 1 wherein in formula (II), m is a number of 1.0 to 2.0 and n is a number of 6.0 to 11.0.

* * * * *